US005975840A

United States Patent [19]

Angle et al.

[11] Patent Number: 5,975,840

[45] Date of Patent: Nov. 2, 1999

[54] PITOT TUBE PUMP HAVING AXIAL-STABILIZING CONSTRUCTION

[75] Inventors: Thomas L. Angle, Suisun, Calif.; James G. Shaw, Draper, Utah; James V. Mangano, Sandy, Utah; Joel Quinn, South Jordan, Utah; Steven D. Osborn; Gary M. Staff, both of Sandy, Utah

[73] Assignee: EnviroTech Pumpsystems, Inc., Salt Lake City, Utah

[21] Appl. No.: 08/958,587

[22] Filed: Oct. 29, 1997

[51] Int. Cl.[6] ..... F04D 1/12

[52] U.S. Cl. ..... 415/88; 415/89; 415/109; 415/131

[58] Field of Search ..... 415/88, 89, 109, 415/168.1, 131, 132, 230, 216.1; 416/244 R, 246

[56] References Cited

U.S. PATENT DOCUMENTS

| | | | |
|---|---|---|---|
| 3,274,938 | 9/1966 | McCracken | 415/131 |
| 3,358,772 | 12/1967 | Bunyan | 416/244 R |
| 3,776,658 | 12/1973 | Erickson | 415/89 |
| 3,795,457 | 3/1974 | Erickson et al. | 415/89 |
| 3,795,459 | 3/1974 | Erickson et al. | 415/89 |
| 3,817,446 | 6/1974 | Erickson et al. | 494/60 |
| 3,817,659 | 6/1974 | Erickson et al. | 415/89 |
| 3,822,102 | 7/1974 | Erickson et al. | 415/89 |
| 3,960,319 | 6/1976 | Brown et al. | 494/60 |
| 3,999,881 | 12/1976 | Crichlow | 415/89 |
| 4,036,427 | 7/1977 | Erickson et al. | 415/89 |
| 4,044,943 | 8/1977 | Brown et al. | 415/89 |
| 4,045,145 | 8/1977 | Erickson et al. | 415/89 |
| 4,076,260 | 2/1978 | Legoy et al. | 277/428 |
| 4,161,448 | 7/1979 | Erickson et al. | 417/84 |
| 4,183,713 | 1/1980 | Erickson et al. | 415/89 |
| 4,230,564 | 10/1980 | Keefer | 210/321.6 |
| 4,243,528 | 1/1981 | Hubbard et al. | 210/104 |
| 4,252,499 | 2/1981 | Erickson | 415/89 |
| 4,264,269 | 4/1981 | Erickson et al. | 415/89 |
| 4,267,964 | 5/1981 | Williams | 415/88 |
| 4,279,571 | 7/1981 | Erickson | 415/89 |
| 4,280,790 | 7/1981 | Crichlow | 415/89 |
| 4,283,005 | 8/1981 | Erickson | 415/89 |
| 4,304,104 | 12/1981 | Grose | 415/89 |
| 4,410,187 | 10/1983 | Legoy et al. | 227/387 |
| 4,674,950 | 6/1987 | Erickson | 415/89 |
| 4,875,826 | 10/1989 | Readman | 415/89 |
| 4,940,394 | 7/1990 | Gibbons | 417/283 |
| 5,098,255 | 3/1992 | Weber | 415/89 |
| 5,192,142 | 3/1993 | Hyll | 415/131 |
| 5,332,373 | 7/1994 | Schendel | 417/424.1 |

*Primary Examiner*—F. Daniel Lopez
*Assistant Examiner*—Richard Woo
*Attorney, Agent, or Firm*—Morriss, Bateman, O'Bryant & Compagni

[57] ABSTRACT

A centrifugal pump of the pitot tube type is structured with axially stabilizing elements which assist in stabilizing the pitot tube assembly of the pump during high pressure operating conditions. The axially stabilizing elements include at least one seat member positionable to register against the discharge tube of the pitot tube assembly to keep the discharge tube in axial alignment and in a selected tension. The pitot pump may also include a pressure relief channel positioned to accommodate increased pressures which may arise from an o-ring failure in the sealing mechanism of the discharge assembly. The axially stabilizing elements reduce the occurrence of fretting and galling resulting from axial forces exerted on the pitot tube assembly and facilitate simplified construction and assembly of the inlet manifold to a discharge assembly or manifold. The cost of constructing and maintaining the centrifugal pump is thereby reduced.

15 Claims, 3 Drawing Sheets

PITOT TUBE PUMP HAVING AXIAL-STABILIZING CONSTRUCTION

BACKGROUND

1. Field of the Invention

This invention relates to centrifugal pumps of the pitot tube type, and specifically relates to such pumps having improved construction to axially stabilize the pick-up tube and discharge assemblies to minimize damage and wear.

2. Statement of the Art

Centrifugal pumps are commonly known in the art and are frequently used in a wide variety of industries to process fluids. Centrifugal pumps of the pitot tube type conventionally include a housing, a rotary casing attached to a drive unit, a stationary pitot tube, an inlet and a discharge or outlet. Fluid entering the pump through the inlet is at a comparatively low pressure (e.g., 100 psi) and is subjected to centrifugal forces as the fluid encounters the rotary casing. The increased pressure (e.g., 500 psi) of the fluid at the periphery of the rotary casing, coupled with the ram effect imposed on the fluid by the positioning of the pitot tube relative to the rotary casing, causes the fluid to enter into the inlet of the pitot tube. The pressurized fluid travels through the pitot tube and into the discharge assembly where it exits the pump. At that point, the fluid may be, for example, at a pressure of 750 psi or higher. The fundamental elements and operation of a pitot tube pump are well known to those skilled in the art.

Pitot tube pumps differ in configuration and construction, but all are subject to wear and degradation as a result of the increased pressures imposed on the fluids being processed through the pump. For example, the increased pressure resulting from centrifugal forces causes thrust loads or axial loads to exist in the housing, in the rotary casing and in the pitot tube and discharge assembly. U.S. Pat. No. 3,822,102 to Erickson et al., U.S. Pat. No. 4,183,713 to Erickson, et al., and U.S. Pat. No. 4,279,571 to Erickson each disclose pitot tube pump configurations which recognize and address thrust loads experienced in the housing, typically near the drive shaft end of the rotary casing. In particular, those patents disclose pumps that are structured with improved thrust bearings or thrust balance means to alleviate the damaging loads.

Axial loads are experienced along the longitudinal axis of the pitot tube and discharge tube thereof due to the high discharge pressures generated by the pump. In addition, radial, tangential, and axial loads are experienced by the pickup tube head and wing as a result of hydraulic forces within the rotating casing itself. The support mechanism of a pitot tube assembly must resist all of these forces. Among the types of damage which may be experienced in a conventional pitot tube pump are a vibration or wobbling of the pitot tube which causes structural failure in the pitot tube, fretting and galling which occurs on the pitot tube and discharge assemblies, fatigue failure or loosening and loss of the mounting bolts and stress failures in the material of the inlet manifold. In some pump configurations, the degrading effects of axial loads are compounded by the cantilevered positioning of the pitot tube within the inlet/outlet manifold. In addition, conventional configurations of pitot tube pumps use very expensive bolts to attach the pitot tube to the manifold thereby significantly increasing the cost of the pump. The time required to fix or maintain the pump can be a significant limiting factor to efficient operation as well.

Thus, it would be advantageous in the art to provide a centrifugal pump of the pitot tube type which is structured to reduce axial forces in the discharge assembly to thereby stabilize the pitot tube and discharge assembly and to provide a pump construction having improved mechanical stiffness and one which is more easily repaired and maintained.

SUMMARY OF THE INVENTION

In accordance with the present invention, a centrifugal pump of the pitot tube type is structured with axially stabilizing elements for maintaining the pitot tube assembly in axial alignment and for maintaining the pitot tube assembly in selected tension. The design significantly reduces the stresses in the mounting assembly as compared to the conventional bolted joint mounting arrangement. In addition, the axial force generated by the fluid discharge pressure, which must be resisted by the mounting assembly, is significantly reduced. The axially stabilizing elements of the centrifugal pump may preferably include removable and replaceable seat members, which facilitate easy maintenance and repair, a pressure relief channel to prevent high axial forces from developing and an axial stress relief o-ring.

The present invention comprises the principal elements of a conventional centrifugal pump, including a pump housing which is connected to a bearing frame having a drive shaft. A rotary casing is attached to the drive shaft and rotates within the pump housing. An inlet manifold is attached to the end bell of the pump housing and has an inlet in fluid communication with the interior of the pump housing. A pitot tube assembly is positioned through the inlet manifold and the pump housing and includes a stationary pitot tube positioned in proximity to the rotary casing. The pitot tube assembly also includes a discharge tube which is in fluid communication with an outlet. The present invention is structured with a discharge assembly which is secured to the inlet manifold and houses an outlet in fluid communication with the discharge tube for moving high-pressure fluid out of the pump.

The pitot tube assembly, inlet manifold and discharge assembly are structured to provide axially stabilizing elements or members which maintain the pitot tube assembly in axial alignment within the inlet manifold and discharge assembly, and which place the pitot tube assembly in tension so that axial and radial movement is reduced. As a result, wobble or vibration in the pitot tube is reduced, and axial forces imposed in the discharge tube are reduced so that damage in the pitot tube assembly is significantly reduced.

The axially stabilizing elements or members may include at least one seat member against which a portion of the discharge tube of the pitot tube assembly is positioned. The seat member substantially encircles the circumference of the discharge tube to further limit lateral (i.e., radial) movement of the discharge tube. The seat member may preferably be a tapered seat which registers against a reciprocatingly sized and dimensioned portion (i.e., a tapered portion) of the discharge tube. The seat member may be removable, thereby facilitating its replacement during repair or routine maintenance of the pump. The seat member may also preferably be made of a material which is dissimilar to the material of both the pitot tube assembly and inlet manifold to thereby effectively reduce or eliminate galling in the seat member and discharge tube.

The present invention may include additional axially stabilizing elements, such as a second seat member located a select distance from another such seat member (e.g., the aforementioned seat member) to further prevent axial movement of the discharge tube between the two seat members.

The second seat member may preferably be tapered to register against a reciprocatingly dimensioned tensioning member, such as a portion of the discharge tube or a reciprocatingly sized and dimensioned tensioning ring which threads onto the discharge tube. Alternatively, the second seat member may be non-tapered, but may provide a close diametric fit between the inlet manifold and the discharge tube. In a preferred embodiment, the second seat member is located near the end of the discharge tube at a distance from the stationary pitot tube, and is positioned between the inlet manifold and discharge assembly. By locating the second seat member between the inlet manifold and the discharge assembly, the second seat member can be easily accessed for repair and is easily replaceable.

By providing two seat members, the discharge tube is positively registered between the seat members and is centrally positioned within the inlet manifold. The seat members may also preferably provide a widened surface area to keep the discharge tube in tension and elongated therebetween without subjecting the contact areas (i.e., the point of contact between the discharge tube and the seat members) to compressive stresses that could lead to failure. Further, the positioning of the seat members within the inlet manifold, or between the inlet manifold and discharge assembly, permits easy access to the seat members and eliminates the need to use expensive securement bolts to join the discharge assembly to the inlet manifold as is conventionally used. The seat members, when tapered in configuration, also provide reduced fretting or galling, thereby reducing repair or maintenance on the pump.

A hydraulic stretching device may preferably be used to place the pitot tube assembly in axial tension against the seat member or members previously described. An elongated threaded portion of the discharge tube is specifically configured with an additional length of threads which allows a selected amount of elongation and tensioning to be placed on the discharge tube by means of a hydraulic tensioning device. When registered against one or more seat members, the selected tensioning force reduces galling or fretting. A locking nut may be associated with the threaded portion of the discharge tube to maintain selective tensioning in the discharge tube established by the hydraulic stretching device. The ability to selectively provide tensioning in the discharge tube with the hydraulic stretching device has the added benefit of imposing lower radial forces on the seat member or members, or other mechanical points of the pitot tube assembly, to reduce cracking and or galling of the pitot tube assembly or pump components than the conventional method of rotating the tension ring with a spanner wrench to a specified torque.

Further, in a preferred embodiment, the centrifugal pump of the present invention may have an axial stress relief o-ring preferably positioned near the end point of the discharge tube farthest from the stationary pitot tube and about the smallest diameter of the discharge tube to minimize the axial force generated by the fluid discharge pressure. The o-ring reduces the elongating forces on the threads of the pitot tube extension that can be produced from the hydraulic action of the pump discharge fluid if it were able to communicate with the seat members in the inlet manifold and the discharge tube. This results in less required axial tension in the discharge assembly and, therefore, less likelihood of fatigue failures.

The centrifugal pump of the present invention may also include a pressure relief channel located about the discharge tube to provide additional assurance of pressure relief in the case of a failure in the axial stress relief o-rings. The pressure relief channel of the present invention may preferably be located in proximity to the seat member of the axially stabilizing element, and is particularly located in proximity to the inlet of the inlet manifold. By being so positioned, the pressure relief channel transfers pressure back to the suction side of the pump (i.e., the inlet) and eliminates the damaging axial forces otherwise imposed on the discharge tube.

The various elements of the present invention aid in axially stabilizing the pitot tube assembly of the centrifugal pump and may be used singly or in a variety of combinations to achieve an optimal axial tensioning in the pitot tube assembly commensurate with the operational parameters of the pump.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENTS

Figure 1:
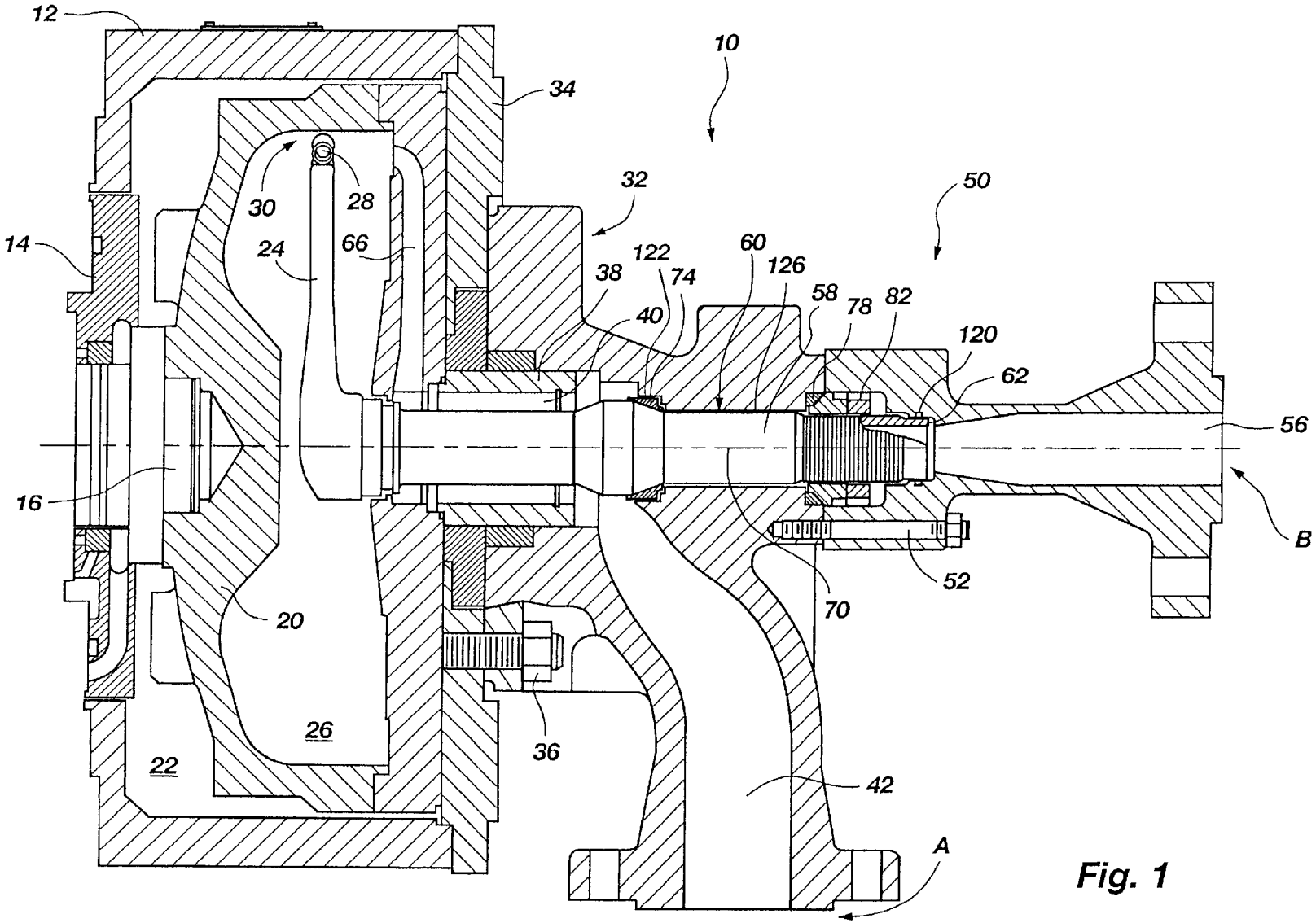
FIG. 1 is a longitudinal cross section of the centrifugal pump of the present invention, some portions of the pump being shown in partial cut-away.

The centrifugal pump 10 of the present invention is illustrated in FIG. 1 in a longitudinal cross section. The centrifugal pump 10 generally comprises a pump housing 12 which is connected to a bearing frame, only the end plate 14 of which is shown, which contains a drive shaft 16. A rotary casing 20 is positioned within the interior 22 of the pump housing 12 and is positioned to contain fluid entering into the rotary casing 20. A stationary pitot tube 24, also referred to herein as a "pick-up tube," is positioned within the interior 26 of the rotating casing 20. The opening 28 of the pick-up tube 24 is located near the periphery 30 of the rotary casing 20 where it is positioned to take in high pressure and high velocity fluid.

An inlet manifold 32 is secured to the end bell 34 of the pump housing 12 by securement means, such as screws 36. A sealing mechanism, generally at 38, seals the pump housing 12 from the inlet manifold 32 and surrounds an annular channel 40 through which fluid flows as it enters from the inlet 42 positioned in the inlet manifold 32.

In the present invention, a discharge assembly 50 is secured to the inlet manifold 32 by appropriate means, such as capscrews 52. The discharge assembly 50 has formed therethrough an outlet 56 which is in fluid communication with the discharge tube 58 of the pitot tube assembly, generally at 60. As used herein, the term "pitot tube assembly" comprises the stationary pitot tube 24 and the discharge tube 58 to the point of its terminus 62 in the discharge assembly 50.

In operation, fluid to be pumped through the centrifugal pump 10 enters into the inlet 42 in the inlet manifold 32. The fluid flows into the annular channel 40 formed about the discharge tube 58 and flows into the interior 26 of the rotary casing 20 through radial passageways 66 formed in the end of the rotary casing 20. As fluid enters into the interior 26 of the rotary casing 20, it is spinning at very high speed (for example, 3000 rpm). The velocity -and pressure of the fluid causes the fluid to enter into the opening 28 of the pick-up tube 24. The high-pressure fluid is then conveyed into the discharge tube 58 and on to the outlet 56 where is leaves the pump 10.

It is important to the understanding of the features of the present invention to note the relative increases in pressure that exist in the fluid as it moves through the centrifugal pump 10. At the inlet 42 side of the pump, indicated at point"A," the pressure of the fluid may be in the range of 0–250 psi (pounds per square inch). When the fluid reaches the periphery 30 of the rotary casing 20 where it is being acted upon by the rotary casing 20 spinning at very high speed, the pressure of the fluid may achieve 1500 psi. As the high-pressure fluid moves into the pitot tube 24 and into the discharge tube 58, the pressure of the fluid increases further and at the point of discharge from the outlet 56, indicated at point "B," the fluid pressure may be as high as 3000 psi. Thus, the pressure of the fluid increases so significantly as it moves through the centrifugal pump 10 that increased forces are being applied to various parts of the pump mechanism. The present invention recognizes, in particular, that a great amount of force is applied along the longitudinal axis 70 formed through the pitot tube assembly 60. In prior art pitot pumps, a significant amount of damage can be sustained in the pitot tube assembly as a result of the forces exerted on the discharge tube 58, such as wobbling manifested in the stationary pitot tube 24, galling, fretting and cracking. The resulting damage to the pitot tube assembly may, in certain circumstances, require frequent maintenance and down-time for the pump.

The centrifugal pump 10 of the present invention, in recognition of the degradation that occurs in prior art pumps as a result of axial forces, provides means for axially stabilizing the pitot tube assembly so that such damage is prevented. In particular, the centrifugal pump 10 is formed with at least one axially stabilizing element which aids in centering the discharge tube 58 along the longitudinal axis 70 of the pitot tube assembly 60 and maintains the discharge tube 58 in axial tension to stabilize the discharge tube 58 against movement. In a preferred embodiment, the centrifugal pump 10 is configured with at least one seat member 74 which is sized and configured to register against a portion of the discharge tube 58. As shown in FIG. 1, the seat member 74 may be tapered and may be configured to register against a reciprocatingly sized and tapered portion 76 of the discharge tube 58. Preferably, the seat member 74 is formed to substantially encircle the circumference of the discharge tube 58 to assure substantially complete registration therewith. Further, the seat member 74 is preferably configured to provide a wider surface area for contact between the seat member 74 and the tapered portion 76 of the discharge tube 58 to allow the discharge tube 58 to be tensioned and elongated without excessive compression in the contact areas. The tapered configuration of the seat member 74 as shown in FIG. 1 may provide such a surface area.

The seat member 74 is preferably removable to facilitate easy replacement during routine maintenance and repair of the centrifugal pump 10. The seat member 74 may, most suitably, be made of a material which is dissimilar to the material of the surrounding inlet manifold 32. Inlet manifolds 32, for example, are conventionally made of stainless steel, and forming the replaceable seat member 74 with material such as Nitronic 50, Nitronic 60, Monel®, 4340 steel, 8620 steel or brass prevents galling, fretting or compressive failures in the seat member 74 and in the discharge tube 58 under increased axial forces.

The centrifugal pump 10 of the present invention may also include a second seat member 78, as shown in FIG. 1, to further stabilize the discharge tube 58 at two different points along the length thereof. Thus, for example, as illustrated in FIG. 1, the second seat member 78 may preferably be positioned a distance apart from the first seat member 74 and be located nearer the extremity 62 of the discharge tube 58. The second seat member 78 is preferably formed to substantially encircle the circumference of the discharge tube 58 to facilitate stabilization of the discharge tube 58. By the placement of the seat members 74, 78 as shown in FIG. 1, the discharge tube 58 is stabilized axially along the longitudinal axis 70 of the pitot tube assembly 60 and is placed in tension. Placing the discharge tube 58 in tension effectively immobilizes the pitot tube assembly so that it can neither move axially nor radially relative to the longitudinal axis 70, and damage to the pitot tube assembly is significantly reduced.

Figure 2:
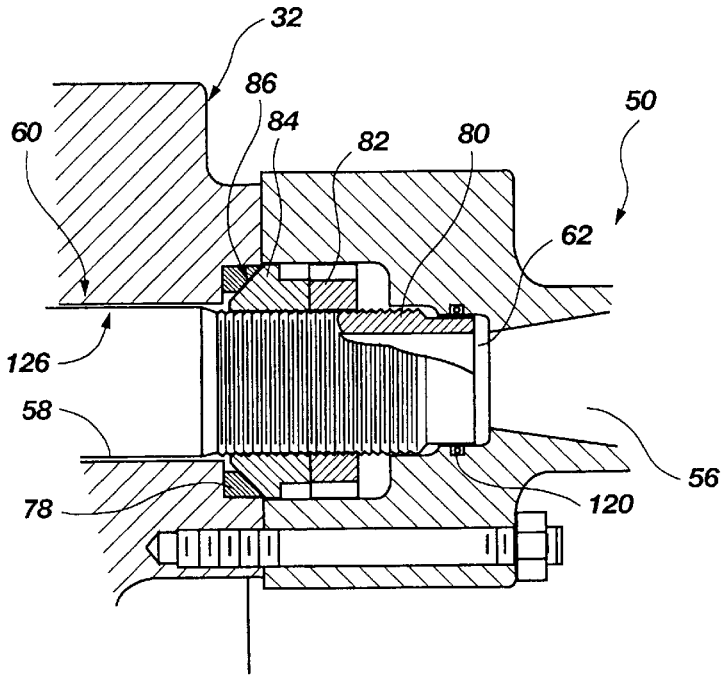
FIG. 2 is an enlarged view in longitudinal cross section of a portion of the discharge tube illustrating a first embodiment of a tapered second seat member.
Figure 3:
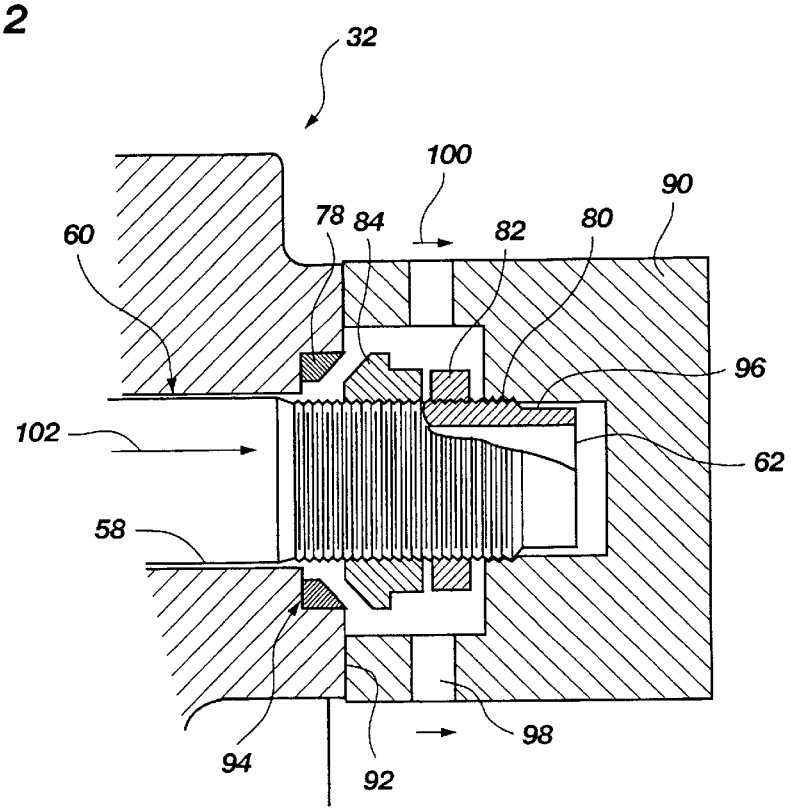
FIG. 3 is an enlarged view of the threaded end of the discharge tube with a hydraulic stretching device attached thereto.

Placement of the discharge tube 58, and thus the pitot tube assembly 60, in tension is illustrated in FIGS. 2 and 3. As more clearly illustrated in FIG. 2, the invention, in one exemplar embodiment, may comprise a discharge tube 58 which is formed with an elongated threaded section 80 which is sized to receive a threaded locking nut 82 and a threaded tensioning ring 84 having a sloped or tapered surface 86 for registering against the second seat member 78. The threaded tensioning ring 84 and locking nut 82 function to keep the discharge tube 58 and pitot tube assembly 60 in tension.

Placing the pitot tube assembly 60 in tension may be accomplished, as shown in FIG. 3, by attachment of a conventionally-known hydraulic stretching assembly 90 to the end 92 of the inlet manifold 32, and about the elongated threaded section 80 of the discharge tube 58. The hydraulic stretching assembly 90 is representationally and simplistically shown in FIG. 3 to simplify the description of the tensioning process, but the method of its operation is well-known. Notably, the tensioning process, using a hydraulic stretching assembly 90, is undertaken before the discharge assembly 50 is attached to the inlet manifold 32, as shown in FIG. 2.

The second seat member 78 is positioned in a depression 94 at the end 92 of the inlet manifold 32 and the elongated threaded section 80 extends beyond the end 92 of the inlet manifold 32. The tensioning ring 84 is then threaded over the elongated threaded section 80 followed by the locking nut 82, which is also threaded onto the elongated threaded section 80. The hydraulic stretching assembly 90 is then positioned over the discharge tube 58 and is threadingly secured to the elongated threaded section 80 at threaded portion 96. The hydraulic stretching assembly 90 rests against the end 92 of the inlet manifold 32. Hydraulic pressure is applied to the hydraulic stretching assembly 90 causing expansion sections 98 of the hydraulic stretching assembly 90 to expand in the direction of arrows 100. As the hydraulic stretching assembly 90 expands, the threaded portion 96 of the hydraulic stretching assembly 90 pulls the discharge tube 58 in the direction of arrow 102 thereby placing the pitot tube assembly 60 in tension.

The tension imposed on the discharge tube 58 and pitot tube assembly 60 is maintained by rotating the tensioning ring 84 down the length of the elongated treaded section 80 until it comes into registration against the second seat member 78; alternatively, the tensioning ring 84 may be tightened against the second seat member 78 until the desired amount of tensioning has been imposed on the discharge tube 58 and pitot tube assembly 60. Then the locking nut 82 is rotated down to come into secure registration against the tensioning ring 84 to maintain it in place. The hydraulic stretching assembly 90 is then removed from the elongated threaded section 80 by disengaging the threaded portion 96 therefrom. The discharge assembly 50 is then bolted onto the inlet manifold 32 as shown in FIG. 2 and previously described.

The second seat member 78 of the present invention simplifies the assemblage of the centrifugal pump 10 and eliminates the need for more expensive securing screws or bolts as are commonly used in the prior art. The second seat member 78, like the first seat member 74, may preferably be removable for ease of replacement and maintenance. The second seat member 78 is preferably formed of a dissimilar material to the inlet manifold 32 to reduce the incidence of fretting, galling or compression failure. Further, the configuration of the second seat member 78 is preferably one where an increased or wider surface area is provided to contact with the tensioning ring 84, as previously described with respect to the first seat member 74.

Figure 4:
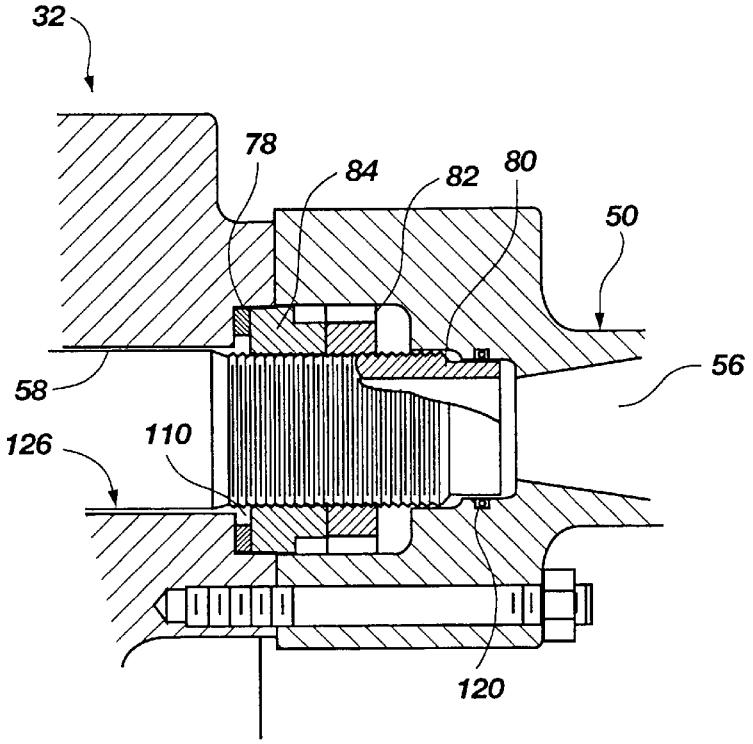
FIG. 4 is an enlarged view of a longitudinal cross section of an alternative embodiment of the seat member in a non-tapered configuration.

In an alternative embodiment of the invention, shown in FIG. 4, the second seat member 78 may be configured without a tapered face. For example, it may be formed as a flattened or planar ring, as shown. The tensioning ring 84 is likewise configured with a planar face 110 to contact and register against the planar second seat member 78. In this embodiment, a close diametrical fit between the inlet manifold 32 and the tensioning ring 84 may be provided to radially stabilize the discharge tube 58. The second seat member 78 of this particular embodiment is more easily and inexpensively manufactured than a seat member of a tapered configuration (i.e., FIG. 2), but may provide less contact surface area than other configurations. The second seat member 78 of this embodiment may experience some degree of fretting or galling more than other configurations, but is still highly effective compared to prior art devices. The second seat member 78 of this embodiment may be removable and, therefore, easily replaced for routine repair or maintenance. Like other alternative embodiments, the second seat member 78 of this embodiment eliminates the need for expensive bolts or screws in securing the discharge assembly 50 to the inlet manifold 32.

The location of the seat members 74, 78 described heretofore is by way of example only. Many other configurations exist for placement of one or more axially stabilizing seat members relative to the discharge tube 58 to selectively tension the discharge tube 58 and pitot tube assembly 60 along a longitudinal axis 70.

The centrifugal pump 10 of the present invention may also be structured with an axial stress relief o-ring 120, shown in FIGS. 1 and 4 as being located near the extremity 62 of the discharge tube 58. The stress relief o-ring 120 may be positioned at virtually any point along the length of the discharge tube 58, but is most suitably positioned about the smallest diameter of the discharge tube 58. The stress relief o-ring 120 reduces the axial force exerted on the discharge assembly 50 generated by fluid discharge pressure exerted in the discharge tube 58 at the extremity 62 thereof and effectively reduces the pre-load requirements on the pitot tube assembly 60 as previously described.

Figure 5:
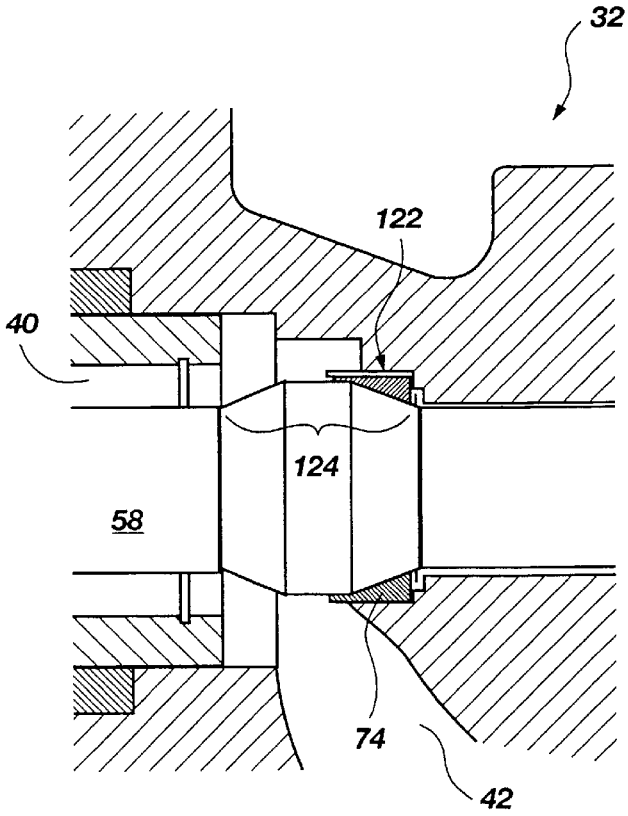
FIG. 5 is an enlarged view in longitudinal cross section of a portion of the discharge tube illustrating a first seat member of the axially stabilizing elements and the pressure relief channel.

The centrifugal pump 10 may also include a pressure relief channel 122, as shown in FIGS. 1 and 5, to accommodate any increase in pressure in the annular space 126 existing between the discharge tube 58 of the pitot tube assembly and the inlet manifold 32 which may result from a failure of o-ring 120. That is, if the o-ring 120 fails as a result of high discharge fluid pressure in the outlet 56, fluid may be forced back between the pitot tube assembly discharge tube 58 and the discharge assembly and inlet manifold 32. Fluid moving through the annular space 126 as a result of the o-ring failure 120 can be vented off through the pressure relief channel and to the low pressure side of the pump 10. The pressure relief channel 122 is preferably formed in the inlet manifold 32 upstream from the annular channel 40 to direct increased pressure back toward the suction side of the pump 10 in the case of an o-ring 120 failure. The pressure relief channel 122 may be suitably formed in conjunction with the seat member 74 since the seat member 74 is positioned to register against a reciprocating surface 76 of the enlarged portion 124 of the discharge tube 58. The pressure relief channel 122 may, therefore, be formed at least partially about the removable seat member 74.

The centrifugal pump of the present invention is structured with axially stabilizing elements which, alone or in combination, aid in accommodating axial forces imposed on the pitot tube assembly under high-pressure operating conditions. The axially stabilizing elements serve to maintain the discharge tube in axial alignment within the inlet manifold and place the discharge tube in selective tension to reduce fretting and galling in the structure. The configuration of the axially stabilizing elements described herein and their positioning within the pump design are determinable by the particular conditions under which the centrifugal pump is operated. Thus, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. A centrifugal pump of the pitot tube type having improved means for stabilizing axial loads in the pitot tube assembly comprising:

a pump housing connected to a bearing frame;

a rotary casing positioned within said pump housing and attached to a drive shaft;

an inlet manifold connected to said pump housing, said inlet manifold having an inlet in fluid communication with said rotary casing;

a discharge assembly connected to said inlet manifold, said discharge assembly having an outlet;

a pitot tube assembly comprising a stationary pitot tube positioned within said rotary casing and a discharge tube positioned through said inlet manifold extending from said pitot tube to said discharge assembly, said discharge tube being in fluid communication with said pitot tube and said outlet and being axially aligned therebetween;

at least one axially stabilizing element positioned along said discharge tube to axially align said discharge tube and to place and maintain said pitot tube assembly in axial tension.

2. The centrifugal pump of claim 1 wherein said at least one axially stabilizing element comprises a first seat member located within said inlet manifold and positioned to register against a portion of said discharge tube to maintain said pitot tube assembly in axial tension.

3. The centrifugal pump of claim 2 wherein said first seat member is tapered and is sized in dimension to register against a reciprocatingly dimensioned portion of said discharge tube.

4. The centrifugal pump of claim 3 wherein said tapered first seat member is removable from said inlet manifold.

5. The centrifugal pump of claim 4 wherein said tapered first seat member is made of a material which is dissimilar from said inlet manifold.

6. The centrifugal pump of claim 1 further comprising a pressure relief channel positioned about said discharge tube in proximity to said inlet.

7. A centrifugal pump of the pitot tube type having improved means for stabilizing axial loads in the pitot tube assembly comprising:

a pump housing connected to a bearing frame;

a rotary casing positioned within said pump housing and attached to a drive shaft;

an inlet manifold connected to said pump housing, said inlet manifold having an inlet in fluid communication with said rotary casing;

a discharge assembly connected to said inlet manifold, said discharge assembly having an outlet;

a pitot tube assembly comprising a stationary pitot tube positioned within said rotary casing and a discharge tube positioned through said inlet manifold extending from said pitot tube to said discharge assembly, said discharge tube being in fluid communication with said pitot tube and said outlet and being axially aligned therebetween; and an axially-stabilizing element positioned along said discharge tube to axially align said discharge tube and to place and maintain said pitot tube assembly in axial tension, said axially-stabilizing element comprising a first seat member, located within said inlet manifold and positioned to register against a portion of said discharge tube, and a second seat member, positioned at a distance from said first seat member and positioned about said discharge tube, to maintain said pitot tube assembly in axial tension.

8. The centrifugal pump of claim 7 wherein said second seat member is removable from about said discharge tube.

9. The centrifugal pump of claim 8 wherein said second seat member is made of material which is dissimilar to the material of said inlet manifold and said discharge assembly.

10. The centrifugal pump of claim 7 wherein said second seat member includes a tapered face sized in dimension to register against a reciprocatingly dimensioned tensioning ring to maintain a selected tension in said discharge tube.

11. The centrifugal pump of claim 7 wherein said second seat member is non-tapered.

12. The centrifugal pump of claim 7 further comprising a pressure relief channel positioned about said discharge tube in proximity to said inlet of said inlet manifold.

13. The centrifugal pump of claim 12 further comprising an axial stress relief o-ring positioned about the smallest outer diameter of said discharge tube to reduce elongating forces in said discharge tube.

14. The centrifugal pump of claim 13 wherein said pressure relief channel comprises a space formed about the first seat member of said at least one axially stabilizing element.

15. A centrifugal pump of the pitot tube type having improved means for stabilizing axial loads in the pitot tube assembly comprising:

a pump housing connected to a bearing frame;

a rotary casing positioned within said pump housing and attached to a drive shaft;

an inlet positioned to direct fluid into said rotary casing;

a discharge assembly connected to said pump housing, said discharge assembly having an outlet;

a pitot-tube assembly comprising a stationary pitot tube positioned within said rotary casing and a discharge tube axially aligned between said pitot tube and said outlet and having a first contact surface;

a second surface axially spaced from said first surface of said discharge tube; and at least one axially stabilizing element positioned to contact said first surface of said discharge tube to axially align and maintain said pitot tube assembly in axial tension between said first surface and said second surface.

* * * * *